US007714721B1

(12) United States Patent
Feibelman et al.

(10) Patent No.: US 7,714,721 B1
(45) Date of Patent: May 11, 2010

(54) ANTI-THEFT RING TAG

(75) Inventors: Jeffrey Feibelman, Providence, RI (US); David Brown, Cumberland, RI (US)

(73) Assignee: Display Technologies, Inc., Johnston, RI (US)

( * ) Notice: Subject to any disclaimer, the term of this patent is extended or adjusted under 35 U.S.C. 154(b) by 289 days.

(21) Appl. No.: 12/014,287

(22) Filed: Jan. 15, 2008

(51) Int. Cl.
*G08B 13/14* (2006.01)

(52) U.S. Cl. ..... 340/568.1; 340/571; 340/568.2; 340/568.8

(58) Field of Classification Search ..... 340/568.1, 340/568.2, 568.8, 571, 572.1, 570; 40/299.01, 40/639; 283/79, 81; 206/303, 486, 487, 206/493
See application file for complete search history.

(56) References Cited

U.S. PATENT DOCUMENTS

| | | | | |
|---|---|---|---|---|
| 659,199 | A | 10/1900 | Anderton | |
| 857,778 | A | 6/1907 | Wittstein | |
| 1,742,982 | A | 3/1929 | Wittstein | |
| 3,668,681 | A * | 6/1972 | Kaplan | 340/537 |
| 4,074,637 | A * | 2/1978 | Lorenzen, Jr. | 109/38 |
| 4,865,352 | A | 9/1989 | Gollon | |
| 5,370,231 | A * | 12/1994 | Nieto | 206/566 |
| D363,087 | S | 10/1995 | McAuley | |
| 5,535,878 | A * | 7/1996 | Reed | 206/6.1 |
| D379,100 | S | 5/1997 | McAuley et al. | |
| D385,579 | S | 10/1997 | McAuley et al. | |
| 5,720,498 | A | 2/1998 | McAuley et al. | |
| 6,006,899 | A | 12/1999 | McAuley et al. | |
| 7,321,308 | B1 * | 1/2008 | Feibelman | 340/572.8 |
| 7,456,741 | B2 * | 11/2008 | Norman et al. | 340/568.1 |
| 2004/0145473 | A1 * | 7/2004 | Royer | 340/568.2 |

* cited by examiner

*Primary Examiner*—Toan N Pham
(74) *Attorney, Agent, or Firm*—Jodi-Ann McLane

(57) ABSTRACT

An anti-theft tag deterring theft of a ring is provided. The anti-theft tag includes an elongated housing for accommodating an EAS marker, a product support member that locks into the housing and which supports the ring, and a flexible, tear resistant strap for securing the ring to the support member, the strap being disposed at least partially within the housing during use. In one embodiment, the support member includes an arcuate seat portion for supporting a circular shank portion of the ring, and a locking member that locks into a corresponding cavity in the housing. In use, the tear resistant strap extends over the ring shank, and the strap ends are received within the cavity of the housing to protect the strap from unauthorized removal by a consumer.

20 Claims, 3 Drawing Sheets

ANTI-THEFT RING TAG

BACKGROUND

It is well known in the art of theft deterrence to use electronic article surveillance (EAS) sensors in order to discourage the theft of consumer products. In use, EAS sensors trigger an alarm if not detached or disarmed before the product is removed from the store. For many products, electronic sensors have been very effective in deterring theft. However, such sensors can be difficult to attach to certain products, for example jewelry, and can often be easily removed from such items even when attached. One higher price item that is difficult to effectively attach an electronic sensor to is a ring. It can be difficult to attach sensors to the band of a ring because if the sensors are overly rigid or cumbersome they can limit the customer's ability to try on the ring before purchasing. However, if the tag is easily removed it will not serve as a deterrent. Thus, tags to prevent theft are often attached to rings by using a thin, yet flexible, tear resistant plastic strap. One such tag is disclosed in U.S. Pat. No. 5,720,498. In the '498 patent the anti-theft tag includes an elongated housing that is attached to the ring by a tear resistant strap that is secured to an outer surface of the tag by a pressure sensitive adhesive. The tag is inserted within a ring display system including slots for receiving the body of the anti-theft tag. While generally effective, attaching the strap to the outside of a tag allows a consumer to tamper with the attachment of the strap in an attempt to remove it.

SUMMARY

The anti-theft tag of the present application addresses the need of providing an anti-theft tag that is easily attached to a ring, is comfortable when trying on, and is tamper resistant.

The anti-theft tag includes an elongated housing for accommodating an EAS marker, a product support member that locks into the housing and which supports the ring, and a flexible, tear resistant strap for securing the ring to the support member, the strap being disposed at least partially within the housing during use. In one embodiment, the support member includes an arcuate seat portion for supporting a circular shank portion of the ring, and a locking member that locks into a corresponding cavity in the housing. In use, the tear resistant strap extends over the ring shank and the ends of the strap are received within the cavity of the housing in order to protect the strap from unauthorized removal by a consumer.

The anti-theft tag described herein discourages unauthorized removal of a ring from the tag, does not improperly interfere with a consumer trying on the ring, is readily attached to the ring and is aesthetically pleasing. The features of the anti-theft tag as described herein may be used with any of a variety of rings, as discussed below.

BRIEF DESCRIPTION OF THE DRAWINGS

The foregoing and other objects, features and advantages will be apparent from the following description of particular embodiments, as illustrated in the accompanying drawings in which like reference characters refer to the same parts throughout the different views. The drawings are not necessarily to scale, emphasis instead being placed upon illustrating the principles disclosed herein.

DETAILED DESCRIPTION OF THE ILLUSTRATIVE EMBODIMENTS

The embodiments disclosed herein relate to an anti-theft tag for use with a ring. As used herein, the term "ring" refers to any jewelry item having a generally circular shank and an ornamental portion, including but not limited to finger rings, toe rings and bellybutton rings. As also used herein, the term "electronic article surveillance" tag or marker refers to any conventional electronic article surveillance (EAS) sensor that triggers an alarm if not detached or disarmed before the product is removed from a designated area, such as a store.

Figure 1:
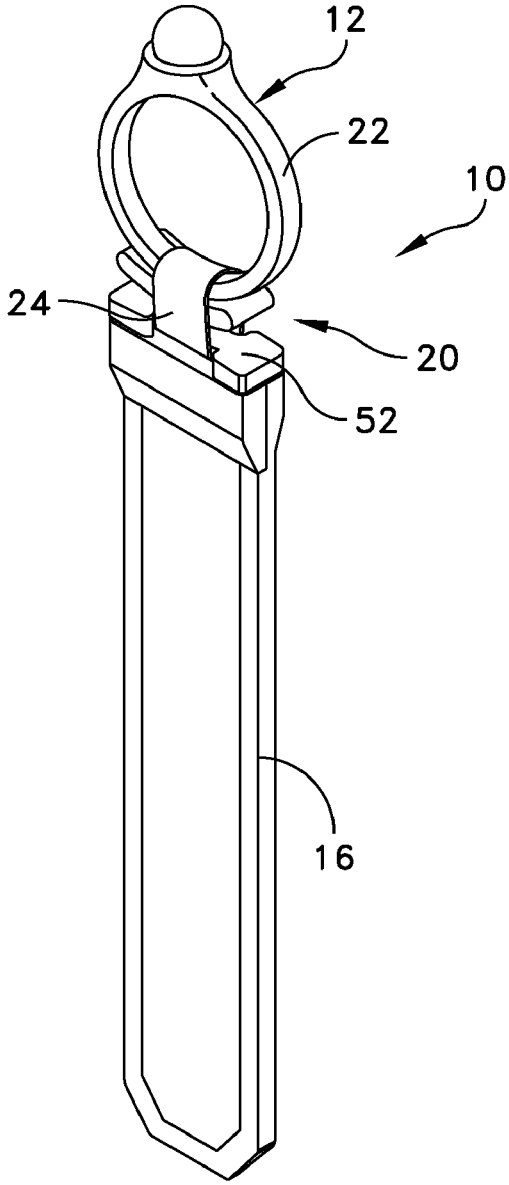
FIG. 1 is a perspective view of an exemplary anti-theft tag for use with a ring according to the present disclosure.
Figure 2:
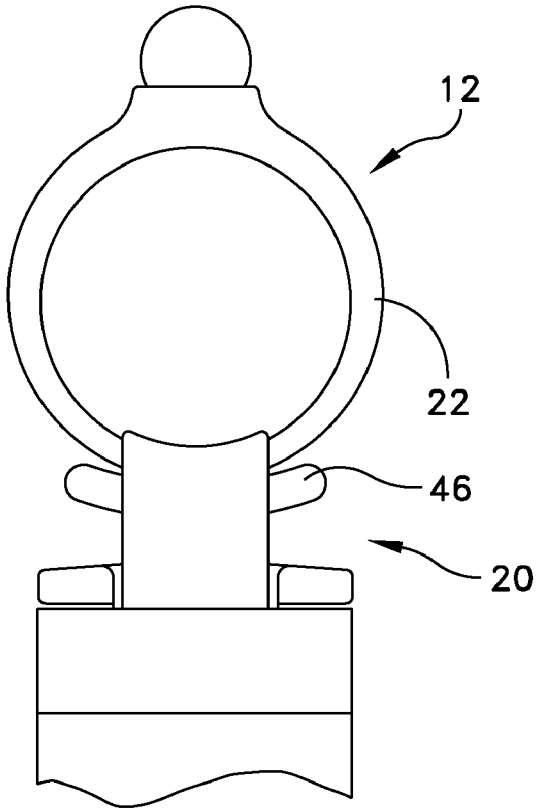
FIG. 2 is an enlarged front view of the product support member of the anti-theft tag of FIG. 1.
Figure 3:
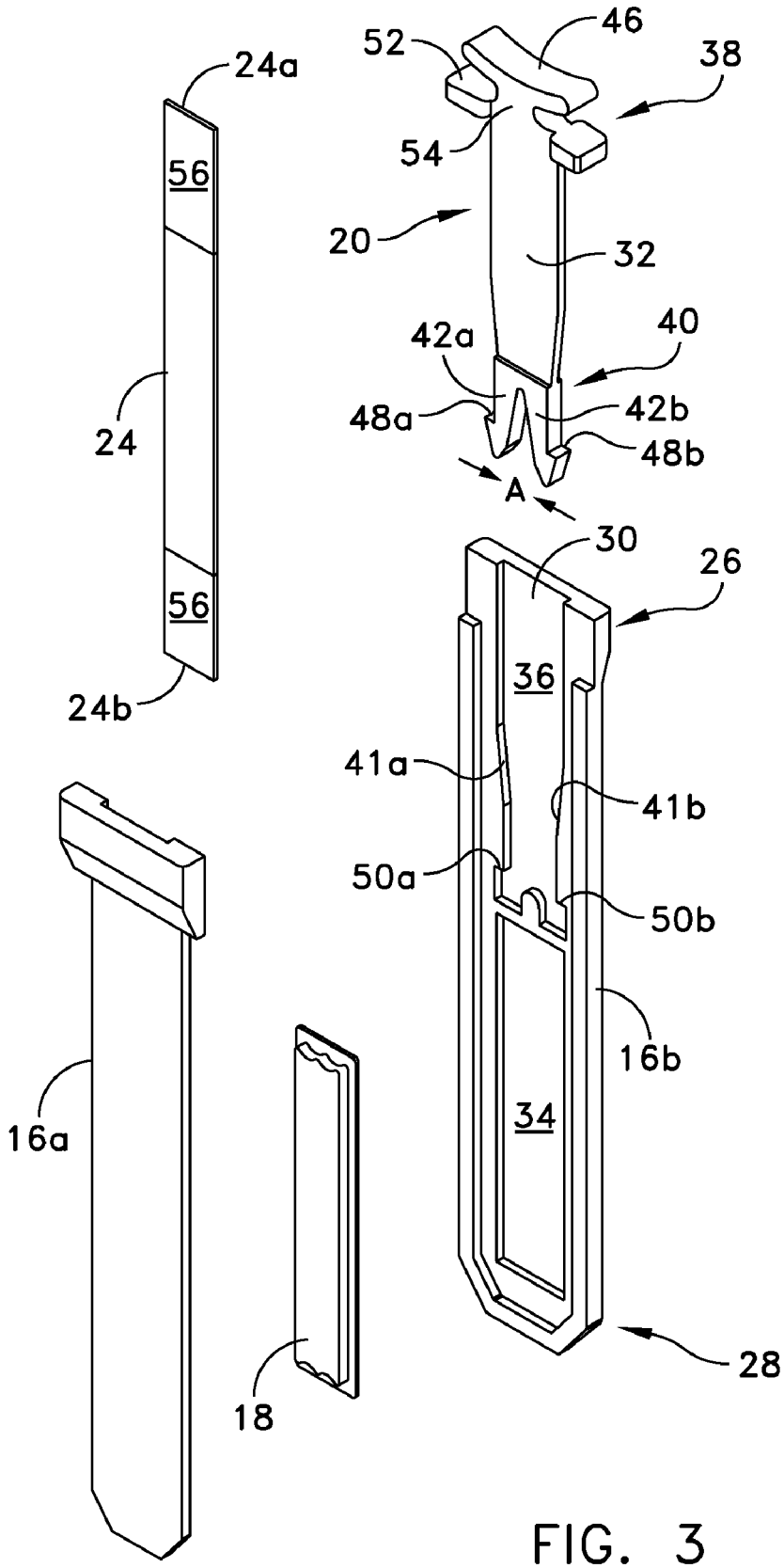
FIG. 3 is an exploded view of the anti-theft tag of FIG. 1.
Figure 4:
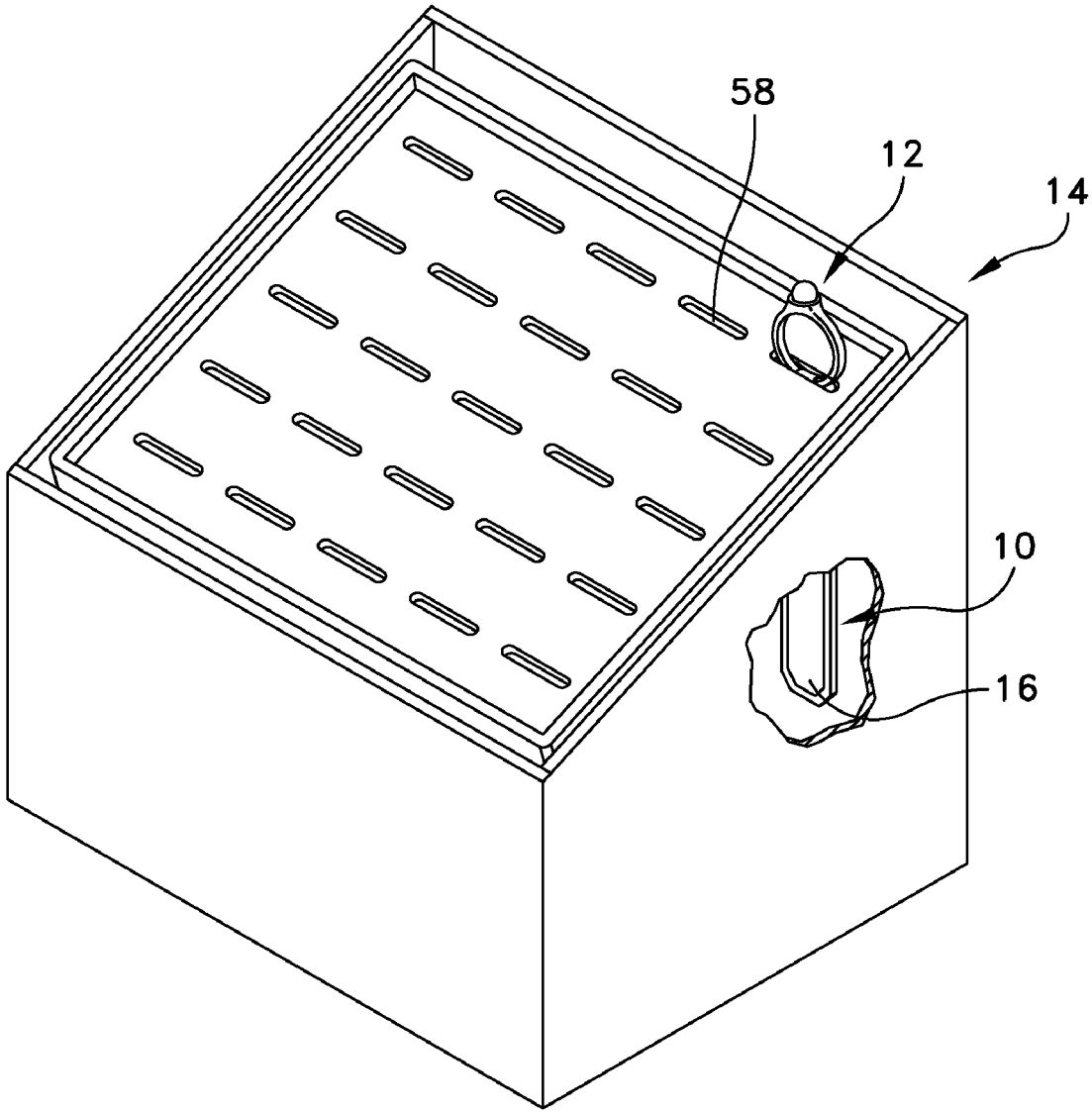
FIG. 4 is a perspective view of a ring display system utilizing the anti-theft tag of FIG. 1.

Referring initially to FIGS. 1-3, an exemplary anti-theft tag 10 used to deter theft of a ring 12 and which can be inserted within a ring display system 14 (FIG. 4) is illustrated. The anti-theft tag 10 includes an elongated housing 16 for supporting an EAS marker 18, a product support member 20 that locks into the housing 16 and which supports the ring 12, and a flexible, tear resistant engagement strap 24 for securing the ring to the support member 20 and within the housing 16.

In the present embodiment, the housing 16 may be molded from a substantially rigid plastic material, for example Mylar, and includes first and second opposing halves 16*a*, 16*b* respectively, which when secured together form the housing 16. A pair of cavities 34, 36 is disposed between the opposing halves. In the present embodiment, the cavities are both formed within the second half 16*b*, with the first cavity 34 having a shape and size to receive the EAS marker 18 therein, and the second cavity 36 having a shape and size to lockingly receive the support member 20, as described in greater detail below. The housing 16 also includes a first end 26 and a second end 28 opposite the first end, the first end 26 having an opening 30 that opens into the second cavity 36. The first end 26 may also be flared to support the support member 20, while the remainder of the housing may include a low profile for insertion within the ring display 14, as described in greater detail below.

As best illustrated in FIG. 3, the support member 20 includes a body 32 having a support end 38 and a locking end 40, opposite the support end. The locking end 40 includes a pair of legs 42*a, b* to secure the support member within the housing during use. Locking legs 42*a*, 42*b* each include a shoulder 48*a, b* that engages with corresponding ledges 50*a, b* disposed within the second cavity 36 so as to lock the support member 20 within the cavity during use. In particular, the legs 42*a*, 42*b* are designed to flex slightly in the direction of arrows "A" as they contact the sloping walls 41*a*, 41*b* of the second interior cavity 36, so as to compress as they are inserted within the cavity. When fully inserted within the cavity, the legs 42*a*, 42*b* return to their non-compressed configuration. In the non-compressed state the ledges 50*a, b* act as a stop and abut the shoulders 48*a, b* of the locking legs to prevent removal of the support member 20 from within the housing 16.

Support end 38 of body 32 includes an enlarged shoulder portion 52, which abuts the first end 26 of the housing when the support member is inserted within the housing. Extending from the enlarged shoulder is neck 54 that supports a seat member 46. Seat member 46 preferably has an arcuate shape for receiving and supporting the shank 22 of the ring 12 in abutting relation thereon during use.

Engagement strap 24 is provided to secure the shank 22 of the ring to the seat member 46 and to the housing 16. The engagement strap 24 may be stamped from a thin, yet flexible, tear resistant plastic, such as nylon, and has a first end 24*a* and a second end 24*b* opposite the first end. The strap 24 may have a generally rectangular shape, as illustrated, and has a thickness designed to fit within the opening 30 in housing 16 and also between body 32 and the interior walls of housing 16. Adhesive 56 is preferably provided on an inner surface of the strap 24 adjacent the first and second ends 24*a*, 24*b* to further secure the strap 24 to opposing sides of the body 32 during use. Use of the anti-theft tag will now be explained with reference to the Figures.

In use, the tag may be pre-assembled during manufacturing with the first and second sides 16*a*, 16*b* of the housing 16 secured together to enclose cavities 34, 36, and the EAS marker 18 supported within the cavity 34. The support member 20 is a separate piece that is secured within the housing once the ring 12 is available for display. The ring is positioned on the seat 46 and the engagement strap 24 is extended over the shank 22 of the ring and seat member 46 and either end 24*a*, 24*b* of the strap is inserted within the opening 30 formed in housing 16. The locking end 40 of the product support member 20 is inserted within opening 30 and into cavity 36, so that the first and second ends 24*a*, 24*b* are sandwiched between the interior walls of the housing 16 and the body 32 of the support member in order to secure the strap to the housing, and the ring to the seat member. Preferably, the strap is secured by a pressure sensitive adhesive applied to an inner surface of the strap 24 adjacent the first and second ends 24*a*, 24*b*. The adhesive may be a permanent adhesive that makes a permanent bond with either side of the body of the support member, although other methods of attachment are also contemplated. As the locking end 40 is inserted within the cavity 36, the legs 42*a*, 42*b* flex in the direction of arrows "A" as they contact the sloping walls 41*a*, 41*b* of the second interior cavity 36. When fully inserted within the cavity, the legs 42*a*, 42*b* return to their non-compressed configuration. In the non-compressed state the ledges 50*a, b* act as a stop and abut the shoulders 48*a, b* of the locking legs to prevent removal of the support member 20 from within the housing 16. Since the strap 24 is relatively thin, the ring 12, with the tag 10 attached thereto, can be tried on without interference. However, when a potential purchaser tries on the ring 12, the elongated housing 16 is highly visible and thus greatly increases the chances of theft detection or prevention. To display the ring, the elongated housing 16 is inserted within one of a variety of slots 58 formed within display 14, as would be known to those of skill in the art.

It will be understood by those skilled in the art that various changes in form and details may be made therein without departing from the spirit and scope of the invention as defined by the appended claims. For example, the materials disclosed herein may be readily changed, as may the dimensions and geometric configurations of the tag, i.e. the tag need not be rectangular, but can have other shapes as well. Also, the tag may or may not be used with a display as disclosed herein. Therefore, the above description should not be construed as limiting, but merely as exemplifications of preferred embodiments. Those skilled in the art will envision other modifications within the scope, spirit and intent of the invention.

What is claimed is:

1. An anti-theft tag for a ring comprising:

a product support member including a body having a locking member at one end and a support end constructed and arranged to support a ring at an opposite end;

an elongated housing including a first end having an opening and a second end opposite the first end, and further including at least one cavity in communication with the opening and configured and dimensioned to receive the locking member of the product support member therein;

a strap including a first end and a second end and constructed and arranged to secure a shank of the ring to the product support member; and wherein during use the strap is received through the circular shank portion of the ring, and the locking member and the first and second ends of the strap are inserted within the opening in the first end of the housing and into the at least one cavity until the locking end is secured within the at least one cavity and the first and second ends of the strap are secured between opposing interior walls of the housing and the body of the product support member so as to secure the ring and product support member to the housing.

2. The anti-theft tag of claim 1, wherein the at least one cavity includes a first cavity configured and dimensioned to support an EAS marker therein and a second cavity configured and dimensioned to receive the locking member.

3. The anti-theft tag of claim 2, in combination with an EAS marker.

4. The anti-theft tag of claim 1, wherein the at least one cavity includes a pair of sloping interior walls and a pair of ledges extending from either wall.

5. The anti-theft tag of claim 4, wherein the locking legs are flexible so as to move toward each other upon engagement with the sloping walls of the at least one interior cavity, each leg including a shoulder portion constructed and arranged to engage the ledges disposed within the at least one cavity in order to prevent removal of the support member from within the cavity.

6. The anti-theft tag of claim 1, wherein the first and second ends of the strap further include a self-sticking adhesive applied to an inner surface thereof, said first and second ends of said strap being adhesively secured to opposing sides of the body of the support member.

7. The anti-theft tag of claim 1, wherein the support end further includes an enlarged shoulder portion, the shoulder portion abutting the first end of the housing when the support member is inserted within the housing.

8. The anti-theft tag of claim 1, wherein the housing includes first and second opposing halves.

9. The anti-theft tag of claim 1, wherein the first end of the housing is flared and the second end of the housing has a low profile constructed and arranged to be inserted within a slot of a ring display.

10. The anti-theft tag of claim 1, wherein the support end includes a seat having an arcuate shape constructed and arranged to support the ring shank.

11. An anti-theft tag for a ring comprising:

a product support member including a body having a support end constructed and arranged to support a ring and a locking member opposite the support end, the locking member including a pair of legs, each leg having a shoulder portion;

an elongated housing including a first end having an opening and a second end opposite the first end;

a first cavity disposed within the housing and configured and dimensioned to support an EAS marker therein;

a second cavity disposed within the housing and in communication with the opening, the second cavity being configured and dimensioned to receive the locking member of the product support member therein and including a pair of sloping interior walls and a pair of ledges extending from either wall;

a strap including a first end and a second end and constructed and arranged to secure a shank of the ring to the product support member; and wherein during use the strap is received through the circular shank portion of the ring, and the locking member and the first and second ends of the strap are inserted within the opening in the first end of the housing and into the at least one cavity until the locking end is secured within the at least one cavity by the ledges of the locking legs abutting the shoulders of the second cavity, and the first and second ends of the strap are secured between opposing interior walls of the housing and the body of the product support member so as to secure the ring and product support member to the housing.

12. The anti-theft tag of claim 11, in combination with an EAS marker.

13. The anti-theft tag of claim 11, wherein the first and second ends of the strap further include a self-sticking adhesive applied to an inner surface thereof, said first and second ends of said strap being adhesively secured to opposing sides of the body of the support member.

14. The anti-theft tag of claim 11, wherein the support end further includes an enlarged shoulder portion, the shoulder portion abutting the first end of the housing when the support member is inserted within the housing.

15. The anti-theft tag of claim 11, wherein the housing includes first and second opposing halves.

16. The anti-theft tag of claim 11, wherein the first end of the housing is flared and the second end of the housing has a low profile constructed and arranged to be inserted within a slot of a ring display.

17. The anti-theft tag of claim 11, wherein the support end includes a seat having an arcuate shape constructed and arranged to support the ring shank.

18. A method of securing a ring to an anti-theft tag comprising the steps of:

providing a product support member including a body having a locking member at one end and a support end constructed and arranged to support a ring at an opposite end;

providing an elongated housing having a first end including an opening and a second end opposite the first end, the opening in communication with a cavity configured and dimensioned to receive the locking member of the product support member therein;

providing a strap including a first end and a second end;

positioning the ring on the support end;

inserting the strap within a shank of the ring and over the body of the product support member;

inserting the first and second ends of the strap and the locking member within the opening formed in the first end of the housing and into the cavity;

securing the first and second ends of the strap between the interior walls of the housing and the body of the support member.

19. The method according to claim 18, wherein the strap includes adhesive at the first and second ends and further including the step of securing the strap to the body of the support member by adhesive.

20. The method according to claim 18, further comprising the step of supporting an EAS marker within the housing.

* * * * *